United States Patent [19]

Frenken et al.

[11] 4,427,645

[45] Jan. 24, 1984

[54] PROCESS FOR THE PREPARATION OF SOLUTIONS FROM ENVIRONMENTALLY NOXIOUS SUBSTANCES

[75] Inventors: Hans Frenken, Odenthal-Osenau; Josef Friedsam, Langenfeld; Karl Voss, Leverkusen, all of Fed. Rep. of Germany

[73] Assignee: AGFA-Gevaert Aktiengesellschaft, Leverkusen, Fed. Rep. of Germany

[21] Appl. No.: 214,466

[22] Filed: Dec. 8, 1980

[30] Foreign Application Priority Data

Dec. 14, 1979 [DE] Fed. Rep. of Germany ..... 2950403

[51] Int. Cl.[3] ..... B01F 1/00

[52] U.S. Cl. ..... 423/658.5; 252/625; 252/626; 366/150; 366/155; 366/156; 366/177

[58] Field of Search ..... 252/626, 627; 423/658.5; 366/155, 156

[56] References Cited

U.S. PATENT DOCUMENTS 3,939,005 2/1976 White ..... 423/658.5

FOREIGN PATENT DOCUMENTS 448968 6/1948 Canada ..... 423/658.5

*Primary Examiner*—Herbert B. Guynn

*Attorney, Agent, or Firm*—Connolly & Hutz

[57] ABSTRACT

The invention relates to a process for the automatic preparation of solutions from environmentally noxious substances in solvents whereby the noxious substance is brought on a receiver and by means of an airtight adapter and a feed connection into a hermetical sealed, storage bin, an exact quantity of the substance is dosed into a measuring and mixing vessel by means of a dosing screw after the solvent is dosed into this vessel, the substance is mixed and dissolved maintained at a certain temperature filtered and delivered to a storage vessel in an automatic sequence.

4 Claims, 4 Drawing Figures

PROCESS FOR THE PREPARATION OF SOLUTIONS FROM ENVIRONMENTALLY NOXIOUS SUBSTANCES

Figure 1:
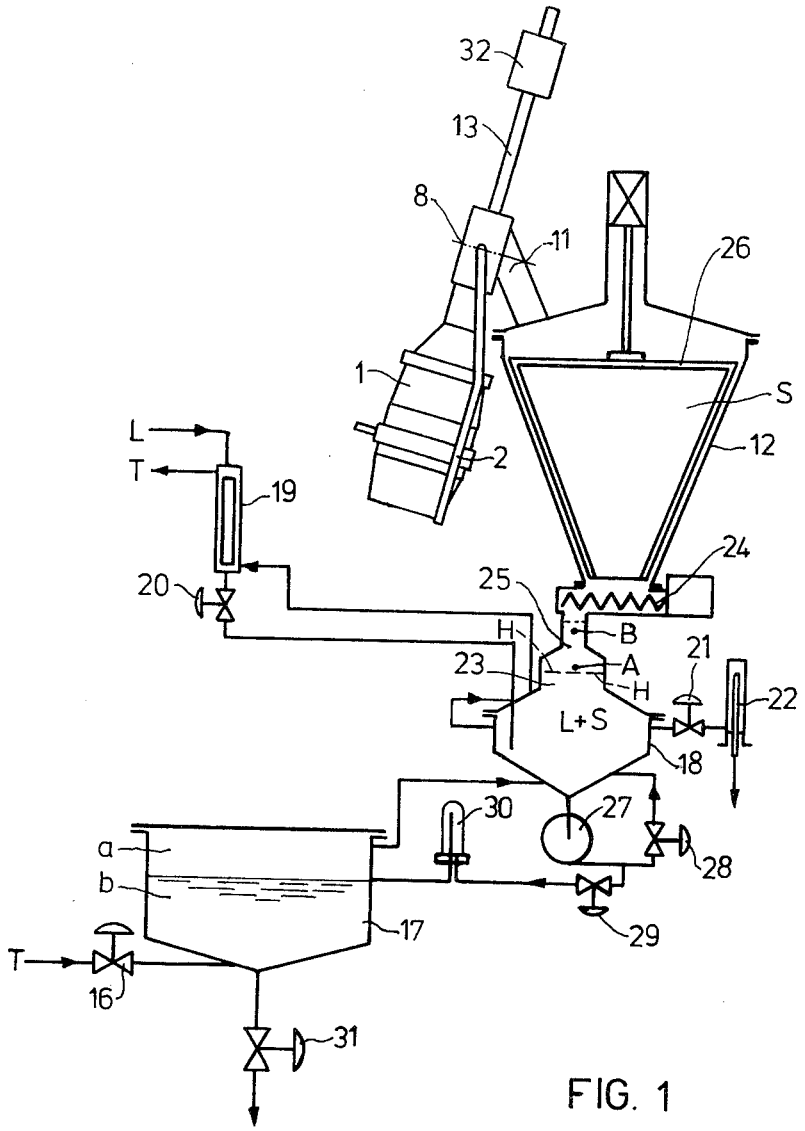

This invention relates to a process for the preparation of solutions from environmentally noxious substances in solvents, in which the proportions of the various constituents required for batch-wise preparation of the solutions are accurately measured, mixed, dissolved, maintained at a certain temperature, filtered and conveyed to a storage container.

It is known to prepare solutions of solids in solvents by introducing the desired quantity of solid into a certain volume of the solvent and dissolving it therein. The desired quantity of solid is determined by weighing the amount for each batch. The volume of solvent may be determined volumetrically by measurement or weighing. Accurate determination of the quantities requires very expensive weighing machines and it is only with considerable difficulty that the weighing process can be carried out in such a manner that corrosive or toxic substances which produce dust have no harmful influence on their environment. The operators must be protected by protective clothing, breathing apparatus and the observance of special protective regulations.

Another known process, in which solvent is first introduced into a container on a weighing apparatus until a predetermined weight is reached and the solid is then introduced until the desired total weight corresponding to the dose is reached also requires expensive weighing devices. In addition, this process has the disadvantage that the devices for feeding the solvent and solid must be so constructed that they do not influence the weighing. The supply of environmentally noxious substances entails even greater technical complications and costs with this process.

The mixing and dissolving of the solid substances in the solvent, the controlling and/or maintaining of the temperature in the solvent and filtration of the solution also require considerable expense in measuring and control devices with this process. The complications and expense are all the greater when numerous batches of the solution are required to be prepared automatically in succession with sufficient accuracy in the quantity of solid in the solvent.

No process has hitherto been known for dissolving environmentally noxious substances in solvents or for dissolving substances in toxic solvents without the environment being polluted at the same time and the process having to be carried out by operators in protective clothing.

It is an object of the present invention to transfer an environmentally harmful substance from a transport container to a storage bin in an accurately measured quantity, mix it with a measured quantity of solvent and dissolve it in said solvent to prepare a filtered solution having a precise temperature without at any stage polluting the environment, and to carry out each step of the process automatically.

The problem is solved according to the invention by the following means:

(a) a container containing the environmentally noxious substance which is to be dissolved is placed on a receiver, (b) the container is securely fixed to the receiver, (c) the cover of the container is replaced by an adaptor and the container is connected to a storage bin through an inlet pipe by means of a snap closure, (d) the receiver with the container thereon is swung through 180° about an axis of rotation so that the noxious substance is poured into the storage bin without any contact with the environment and is agitated by a stirrer to prevent the formation of bridging bonds (e) a given quantity of solvent is measured into a measuring mixing vessel which is arranged under the storage bin and which is connected only to the storage bin through a dosing screw and air-tightly sealed off from the outside, (f) a given quantity of the environmentally noxious substance is then added from a delivery device, (g) the substance is mixed with the solvent by means of a mixing and delivery pump and dissolved therein, (h) after the substance has been mixed with the solvent and dissolved in it, the resulting solution is pumped through a filter into a storage container by means of a mixing and delivery pump, and (i) to optimize the solution of substance in the solvent, the measuring and mixing vessel, the storage container and the solvent in a solvent container are maintained at a certain temperature.

In a preferred embodiment of the invention, accurate dosing of a given quantity of solvent is carried out by first introducing the solvent to be measured into the measuring and mixing vessel up to a certain mark, then opening an overflow valve for fine adjustment of the quantity and adjusting the solvent to the exact, preselected quantity by means of an adjustable overflow pipe.

Addition of the measured quantity of environmentally noxious substance to the solvent is carried out according to a preferred embodiment by delivering the substance from the storage bin into the measuring and mixing vessel by means of a metering screw until the level of mixture in the vessel reaches a mark in the upper, constricted part of the vessel.

The process is found to provide a further, unexpected advantage in that the duration of each stage of the process and the sequence of the various stages in the preparation of each batch of solution are controlled by a computer and the operation of the computer may be controlled either manually or by an upper and a lower level mark in the storage vessel for preparing batches of solution.

It has also been found that it is advantageous if for each of the possible chosen concentration ratios of environmentally noxious substance to solvent, a corresponding level is fixed and examined in the highly constricted, upper part of the container, and any change in concentration is carried out by mechanically shifting an overflow tube vertically for fine adjustment of the solvent.

It is surprisingly found that this process provides a very simple method by which, without any contamination of the environment or harm to the operators carrying out the process, heavily dust producing, corrosive and toxic substances and even, if special precautions are taken, radio-active substances, can be treated fully automatically in batches to be mixed with measured quantities of a solvent dissolved, filtered, tempered and transferred to a storage bin from which they can be removed as solutions as and when required.

The introduction of the environmentally harmful substance into the storage bin is advantageous. The substance is delivered in a sealed container and placed on the receiver and securely attached thereto. In the case of less harmful substances, the lid of the container is removed and replaced by an adaptor which is connected by a quick-closure mechanism such as a tapered socket to the filling device in such a manner as to be sealed against dust and air.

In the case of substances which heavily contaminate the environment, the container may be sealed by a foil placed under the lid and welded to the edge of the container. This foil is cut open crossways or in a triangle by a device in the adaptor when and only when the container has been connected to the filling device in a dust-proof and air-tight manner.

When dealing with radiating, radio-active materials, the usual protective measures must be used for the technical equipment, according to the intensity of radiation, such as lead-lined container, encased pipes or the enclosure of the entire installation in a chamber in which radiation is sealed off from the environment. The container for the harmful substance is placed on the receiver inside the chamber by mechanical means such as remote controlled gripping devices and automatically locked to the receiver.

The simple and accurate dosing of the solvent and of the environmentally harmful substance comes as a surprise to the man in the art. This process requires no major expenditure in apparatus and measuring and control devices. Dosing is effected with high accuracy in a single container without a weighing machine.

A solvent is firstly roughly measured into the measuring and mixing vessel up to a mark A. When mark A has been reached, the introduction of solvent is stopped and fine adjustment is then carried out by discharging solvent through an overflow valve into a vertically adjustable overflow tube until the measuring vessel contains the exactly required quantity of solvent. The accuracy of measurement is enhanced by the fact that the diameter of the vessel is reduced in the region of fine adjustment.

The quantity of solvent is calculated to provide the desired ratio of noxious substance and solvent in the total volume of solution which will fill the measuring vessel up to a mark B in the upper constricted part of the vessel. This method has the considerable advantage that the noxious substance need not be weighed but need only be introduced continuously until the solution or mixture reaches the mark B.

In this method of measurement, the constants of the substance and the solvent, the temperature of the solvent and the speed and duration of delivery through the metering screw play a certain role and may lead to mixing ratios or solution ratios deviating from the nominal value.

The temperature is therefore kept constant in this process by maintaining the installation at a certain temperature. The delivery of noxious substance from the storage bin to the measuring vessel is carried out by means of a dosing screw which is driven by a synchronous motor so that a constant quantity of substance is always delivered per unit time. A stirrer in the storage bin ensures that solid substance is constantly fed into the dosing screw.

In the case of an insoluble substance, the volumes would be additive. This does not apply to the process according to the invention since the substance is one which is required to be dissolved. When the substance is introduced into the measuring vessel and during the time required for introduction of the total quantity, a portion of the substance already dissolves in the solvent, so that the total volume diminishes.

The volume of solvent displaced by given quantities of solid in a given solution is therefore determined empirically for the process by laboratory experiments and the results are entered in a table from which a calibration curve is drawn up. The method of determining the volume of solvent displaced will be illustrated by means of an example. Let the temperature at which the process is carried out be 20° C. The rate of delivery in the screw is 10 gram per second. The measuring vessel contains 850 gram of solvent. It is required to prepare a solution of sodium chloride in water ($NaCl/H_2O$).

The substance is introduced at a rate of 10 g per second into a vessel containing 850 g of $H_2O$ kept at 20° C., and the resulting change in volume $\Delta V$ is read off in ml. If the experiment is carried out several times for different solid contents (e.g. in this case twice), the following table is obtained, in which the specific change in volume Vs is calculated from the formula:

$$Vs = \frac{\text{Gram of solid substance}}{\text{change in volume obtained}} \quad \frac{(g)}{(ml)} \left( \frac{\text{Column 1}}{\text{Column 4}} \right)$$

and Vsm is calculated as the mean value.

| Solid NaCl g 1 | Solvent $H_2O$ g 2 | Solid content in % by weight 3 | Change in Specific Volume: volume Δ V ml 4 | Vs g/ml 5 | Change Vsm g/ml 6 |
|---|---|---|---|---|---|
| 50 | 850 | 5.56 | 21.2 | 2.358 | 2.358 |
| 50 | 850 | 5.56 | 21.2 | 2.358 | |
| 100 | 850 | 10.55 | 45.2 | 2.315 | 2.304 |
| 100 | 850 | 10.53 | 43.6 | 2.294 | |
| 150 | 850 | 15.0 | 66.2 | 2.266 | 2.266 |
| 150 | 850 | 15.0 | 66.2 | 2.266 | |
| 200 | 850 | 19.05 | 90.0 | 2.222 | 2.222 |
| 200 | 850 | 19.05 | 90.0 | 2.222 | |
| 300 | 850 | 26.09 | 134.4 | 2.232 | 2.226 |
| 300 | 850 | 26.09 | 135.2 | 2.219 | |

For each desired solid content in percent by weight (Column 3), it is possible to determine the change in volume ($\Delta V$) produced by a quantity of solid (column 1) in its solvent (column 2) by interpolating the values in the table (column 6) or by reading off the value from a graph drawn up from the values in column 6.

This will now be demonstrated by a calculation given by way of example.

Let the measuring and mixing vessel have a capacity of 2,000 ml up to the mark B in the upper, highly constricted part.

It is required to prepare a NaCl solution having a solid content of 20% by weight. When the quantity of solvent is 850 g $H_2O$ (80%), the total weight of solution and salt is 1062.5 (100%), 212.5 g NaCl (20%) having been added. The volume of solvent is 850 ml. The volume which is replaced by the solvent is obtained by dividing by the factor 2.223 (after interpolation of the value 2.222 from column 6 of the table), and thus found to be 95.59 ml. The total volume is therefore 850+95.59 ml=945.59 ml. To adjust the result to the total capacity of the measuring vessel of 2,000 ml, the volumes must be multiplied by the factor 2.115 (2,000÷945.59), and the results are as follows:

| |
|---|
| 1797.8 ml $H_2O$ |
| 202.2 ml NaCl |
| 2000.0 ml volume |
| or |
| 1797.8 g $H_2O$ (80%) |
| 449.5 g NaCl (20%) |
| 2247.3 g 100% |

The solvent is introduced into the measuring vessel up to the mark A, which in this example may be placed at 1900 ml. The solvent level is lowered to 1798 ml in this example by adjusting the overflow tube for fine adjustment, and solid substance is then added until the mark B is reached. 449 g of solid are then introduced until the level of solvent in the container rises by 202 ml to the mark B.

This advantageous and surprisingly simple method of dosing is not restricted to this example but may be applied to small and large batches and all conceivable quantities of solids in solvents. The method may, of course, also be used for the addition of measured quantities of solvents to solvents. The method has been described with the aid of the example of sodium chloride since this is the easiest to check but it may be used for any solid materials, in particular for dissolving environmentally harmful solids in solvents.

Due to the simplicity of the measuring process and the mixing and dissolving process and the discharge of the solution at a certain temperature through a filtering device into a storage vessel, the process can easily be controlled with constant accuracy by computer.

The computer controls the supply of solvent up to the mark A and then opens the overflow valve for fine adjustment by means of the overflow tube. After an interval of time required for the fine adjustment, the computer closes the valve and switches on the motor for the delivery screw until the mark B is reached, and then switches on the mixing and dissolving pump for the length of time required to dissolve the solid in the solvent. When complete solution has been obtained, the computer switches off the mixing cycle by way of valves and releases the process of discharging the solution into a storage vessel through the filter. The process of solution may be controlled by manual control of the computer operation if desired or alternatively the computer may be adjusted to prepare batches whenever the quantity left in the storage vessel falls below a certain level. For this purpose, level detectors in the storage vessel are examined as marks a and b and preparation of the batches is begun when the level falls below the mark b and solutions continue to be prepared until mark a is reached.

The computer also controls and regulates the temperature in the storage vessel and in the measuring and mixing vessel by varying the dwell time of the mixture during preparation of the batches.

By projecting the consumption of solid, the computer gives directions for feeding further solid into the storage bin.

Figure 2:
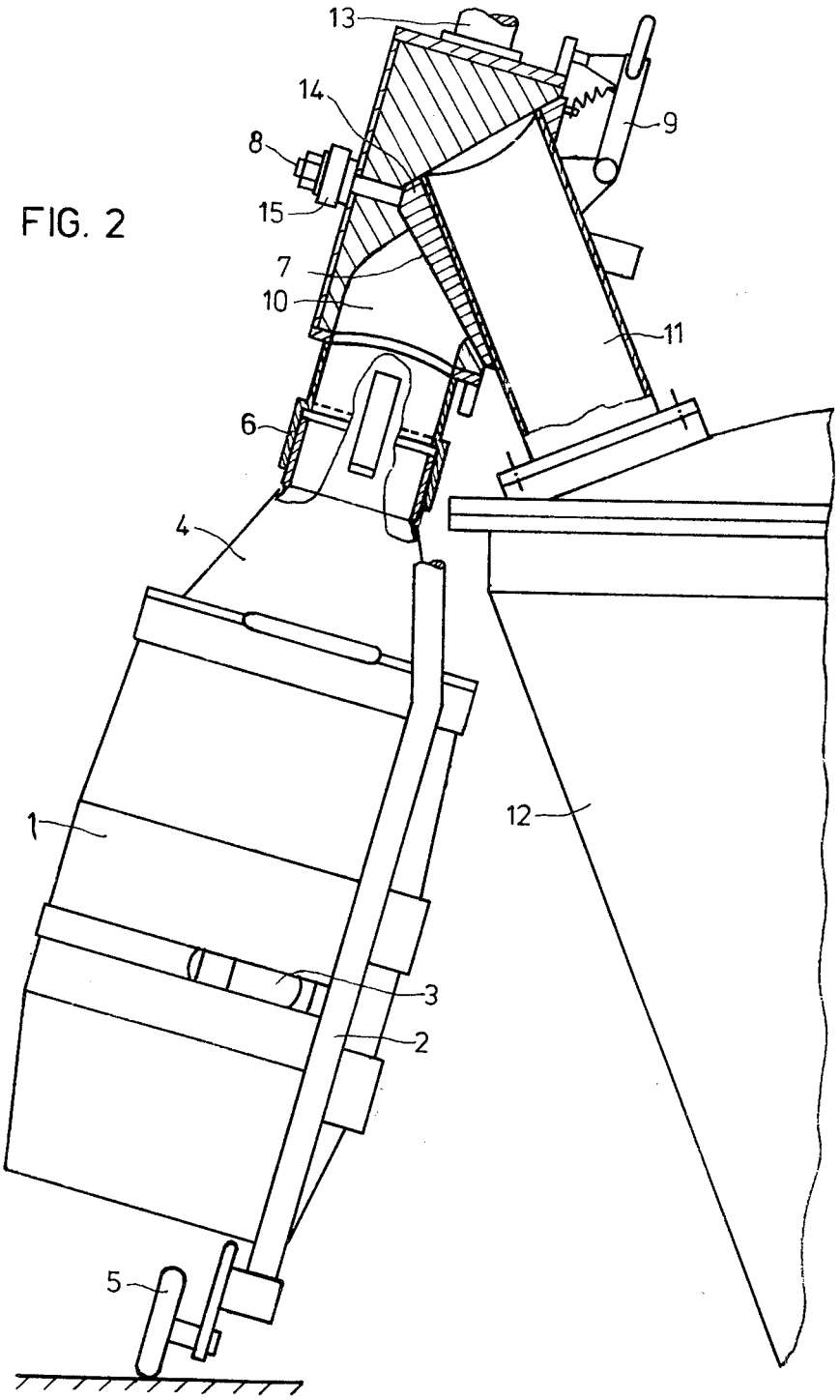
Figure 3:
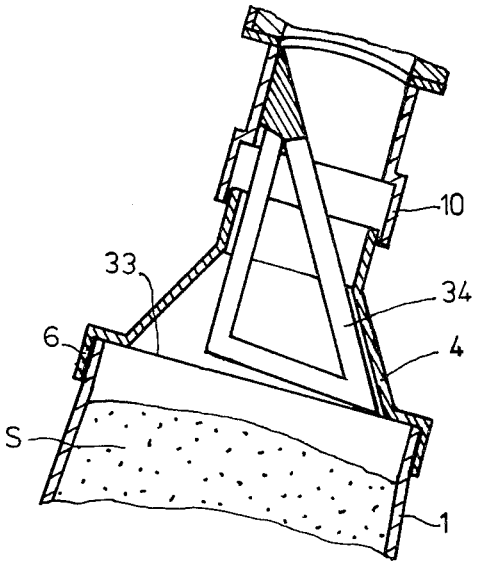
Figure 4:
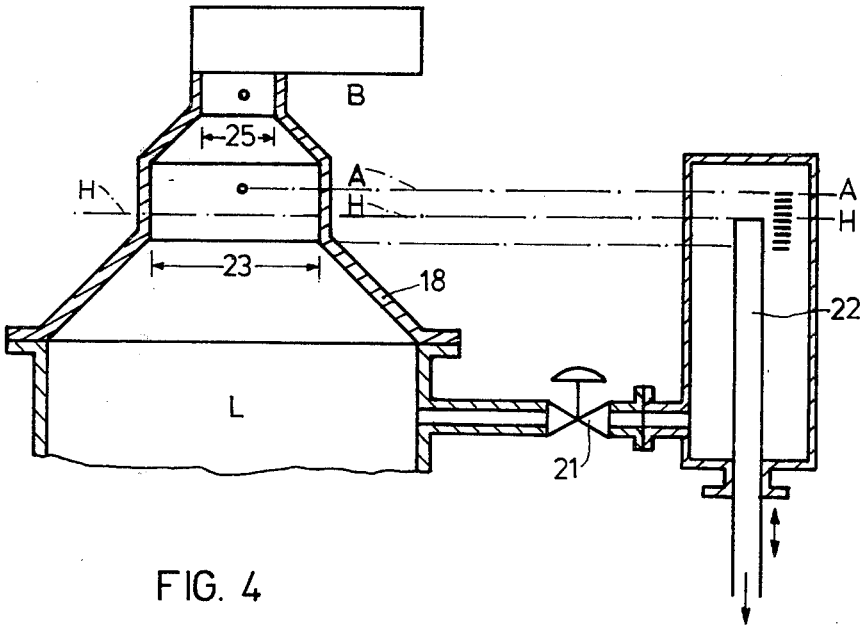

Further advantages, features and possibilities of application may be found in the following description given with reference to the accompanying drawings, in which FIG. 1 is a schematic representation of an apparatus for carrying out the process, FIG. 2 represents an apparatus for dust-free and air-tight feeding of substances into a storage bin, FIG. 3 shows a device for opening a container which is sealed with a foil, and FIG. 4 represents the fine adjustment device for measuring out the solvent.

FIG. 1 illustrates by way of example an apparatus for carrying out the process. At the beginning of the process, a solid substance (S) is fed into a storage bin 12. Since the substances are liable to be environmentally harmful, a special device of the type described with reference to FIG. 2 is required for introducing the solid.

An environmentally harmful solid substance is delivered in containers 1, placed on a receiver 2 and secured by a clamp 3. Depending on the size of the installation, the placing of the containers on the receiver and their attachment may be carried out manually or with transport devices such as fork-lifts or fully automatically by means of remote controlled transport apparatus (robots).

The lid of the container 1 is removed and replaced by an adaptor 4. If the container 1 contains very harmful substances, it may in addition be sealed by a metal or plastics foil 33 welded to the edge of the container under the lid.

Using a foot control in the case of relatively small installations, or hydraulic or pneumatic devices of known type, the container 1 with adaptor 4 placed on it is pushed into a rapid closure device 6 by a lifting device 5 to be sealed off air-tightly and dust-free. If the container 1 is also sealed off with a foil 33, a V-shaped or cruciform knife 34 in the upper part of the closure mechanism 6 may be used to cut a V-shaped or cruciform opening in the foil 33 as the adaptor 4 is pushed into the device 6. Since the container 1 is by then already connected to a feed pipe 10 by way of the adaptor 4, none of the substance in the container can enter the environment (FIG. 3).

When the dust-free and air-tight connection of the container 1 to the feed pipe 10 has been established, the receiver 2 is swung upwards with the container 1 through an angle of 180° about the axis 8, and the feed pipe 10 at the same time slides on an external cone 7 until the pipe 10 and inlet pipe 11 of a storage bin 12 together form a smooth passage along which the solid substance S can flow into the storage bin 12.

A compensating weight 32 may be mounted on an operating lever 13 to facilitate handling of the lever (FIG. 1). In relatively large installations, a geared motor may be provided to execute the pivotal movement through 180°. A metal internal cone 14 which fits into the plastics external cone 7 is tensioned against the external cone 7 on the axis of rotation 8 by means of plate springs 15 to ensure that an optimally tight seal is maintained. In the upper position, the receiver 2 for the container 1 fits into a stop device 9.

In an automatically controlled process, the command "start" initiates the following sequence of steps (FIG. 1):

A temperature controlling agent T for cooling or heating is first admitted into temperature controlling jackets of a storage container 17 for solvents L and solid substances S by opening of a valve 16, and it flows through these jackets to enter temperature controlling jackets of a measuring and mixing vessel 18 and heat exchanger of a solvent container 19, from where it is discharged (see arrow) to be treated and recycled through the valve 16 (not shown).

When solvent valve 20 opens, the measuring and mixing vessel 18 is filled with solvent to a level A, and the solvent is adjusted to the temperature of the batch by flow through the heat exchanger in the solvent container 19 and the measuring and mixing vessel 18.

As the solvent reaches the measuring point A, the inlet valve 20 is closed and an overflow valve 21 opened (FIG. 4). The level of solvent is thereby accurately adjusted to a height H of the adjustable overflow edge of an overflow tube 22, and excess solvent is discharged and returned (see arrow). For all types of solution processes, the overflow edge of the overflow tube 22 is situated so that the desired solvent level lies at a predetermined level indicated by the H—H in FIGS. 1 and 4 in a part of the vessel 18 having a constricted cross-sectional area 23, so that a high degree of accuracy is obtained for the required volume of solvent.

After expiration of the time required for adjusting the level (ca. 5–20 seconds), valve 21 is closed and a metering screw 24 is switched on. Solid substance S is then delivered from the storage bin 12 into the measuring and mixing vessel 18 at a constant rate until a mark B for the level of solvent L and solid S is reached in an even more reduced cross-section 25. The screw 24 is then switched off. During this dosing process, a stirrer 26 (FIG. 1) is switched on to prevent a bridging bond of solid forming in the storage bin 12.

The mark B for the level of solvent L and solid S is situated at one and the same point for all possible concentration ratios. Any desired change in concentration is brought about simply by mechanically displacing the overflow edge of the overflow tube 22 (double arrows). A particular mixture of solid and solvent in a solution is obtained simply by adjusting the proportion of solvent.

After completion of the dosing process, a mixing and delivery pump 27 is switched on. The components, solid S and solvent L, are then pumped round until a homogeneous solution has been obtained.

The time require for this operation is determined empirically. At the same time, the solution is maintained at a certain temperature already described, either in order to accelerate the process of solution or in order to remove heat produced. This may also be carried out in order to obtain a solution at a particular temperature.

After completion of the process of solution, the pumping valve 28 is closed and at the same time discharge valve 29 is opened and the finished solution of L+S is pumped into the storage vessel 17 through a filter 30 provided to remove impurities or undissolved particles. The solution may be removed for use through a valve 31.

The installation is then ready to start preparation of the next batch. Starting of the operation may be initiated manually or automatically. If it is initiated automatically, two marks a and b in the storage vessel 17 are examined. When the level of solution in the vessel reaches the lower mark b, the preparation of solutions is started and is continued until the solution reaches the upper mark a. The duration and functions of the process are controlled in known manner by means of a conventional computer.

We claim:

1. A process for the preparation of solutions from environmentally noxious substances in which the various proportions required for the batchwise preparation of the solutions are accurately measured, mixed and dissolved, maintained at a certain temperature, filtered and delivered to a storage vessel, characterised in that:

(a) the environmentally noxious substance to be dissolved, contained in a container, is placed on a receiver;

(b) the container is securely attached to the receiver;

(c) the lid or closure member of the container is replaced by an adaptor, and the container is connected air-tightly and dust-free by way of the adaptor to a feed connection of a storage bin by means of a rapid closure device;

(d) the environmentally noxious substance is poured into the storage bin without contact with the environment by pivoting the receiver together with the container through 180° about an axis of rotation, and the substance is agitated by a stirrer to prevent the formation of bridging bonds;

(e) a given quantity of solvent is measured into a measuring and mixing vessel which is arranged under the storage bin and connected to the storage bin only by a dosing screw and in such a manner that it is air-tightly sealed-off from outside;

(f) a given quantity of the environmentally noxious substance is then added from the dosing screw;

(g) the substance is mixed with the solvent by pumping with a mixing and delivery pump and dissolved therein;

(h) after the substance has been mixed with the solvent and dissolved in it, the solution of the substance in the solvent is pumped into a storage vessel through a filter by means of the mixing and delivery pump, and (i) to optimize the solution of the substance in the solvent, the measuring and mixing vessel, the storage vessel and the solvent in a solvent container are maintained at a certain temperature.

2. A process according to claim 1, characterised in that for dosing the solvent, the said solvent is first introduced into the measuring and mixing vessel up to a mark (A) and an overflow valve is then opened for fine adjustment of the quantity of solvent, and the quantity of solvent is adjusted to an exact, freely selectable quantity by means of an adjustable overflow tube.

3. A process according to claim 1, characterised in that the environmentally noxious substance is delivered from the storage bin into the measuring and mixing vessel by means of a dosing screw until the mixture of the substance in the solvent reaches a mark in the upper, constricted part of the vessel.

4. A process according to claim 1, characterised in that a level point (B) in a most constricted upper part of the mixing and measuring vessel is fixed and examined for all the different concentrations of an environmentally noxious substance in said, solvent which can be chosen, and any change in concentration is carried out by mechanically displacing an overflow tube vertically for fine adjustment of the quantity of solvent.

* * * * *